US005099887A

United States Patent [19]

Hooper

[11] Patent Number: 5,099,887

[45] Date of Patent: Mar. 31, 1992

[54] DRAIN COLLAR

[76] Inventor: Oliver F. Hooper, Rte. 1, Box 598, Forest, Va. 24551

[21] Appl. No.: 480,853

[22] Filed: Feb. 16, 1990

[51] Int. Cl.[5] ..... F16L 55/10; E04B 1/00

[52] U.S. Cl. ..... 138/89; 138/113; 52/98; 235/901; 247/11; 247/39; 4/252.1

[58] Field of Search ..... 138/89, 96 R, 113, 114, 138/115, 148, 38; 52/98, 99, 100, 220; 165/71; 137/68.1, 375; 285/901; 4/252; 249/10, 11, 39, 177

[56] References Cited

U.S. PATENT DOCUMENTS

| | | | |
|---|---|---|---|
| 856,106 | 6/1907 | Snow . | |
| 885,371 | 4/1908 | Petracchi | 52/99 |
| 2,202,147 | 5/1940 | Gerriets | 52/99 |
| 2,846,852 | 8/1958 | Cappel | 52/98 |
| 2,976,543 | 3/1961 | Turner et al. | 4/252 |
| 3,113,595 | 12/1963 | Cotman | 138/113 |
| 3,126,918 | 3/1964 | Eaton | 138/113 |
| 3,213,889 | 10/1965 | Cotman | 138/113 |
| 3,319,268 | 5/1967 | Blumenkranz | 4/252 |
| 3,349,412 | 10/1967 | Schwartz et al. | 4/252 |
| 3,400,411 | 9/1968 | Harvey | 4/252 |
| 3,421,551 | 1/1969 | Currier | 138/178 |
| 3,528,456 | 9/1970 | Scheffler | 138/113 |
| 3,568,382 | 3/1971 | Munn | 52/99 |
| 3,800,486 | 4/1974 | Harvey | 52/98 |
| 3,807,744 | 4/1974 | Gibling | 277/207 |
| 3,821,820 | 7/1974 | Thompson | 4/252 |
| 4,052,759 | 10/1977 | Hill | 4/252 |
| 4,260,330 | 11/1986 | Izzi, Sr. | 4/288 |
| 4,303,102 | 12/1981 | Hugley | 138/96 R |
| 4,432,485 | 2/1984 | Smith | 138/38 |
| 4,482,161 | 11/1984 | Izzi, Sr. | 277/207 |
| 4,623,170 | 11/1986 | Cornwall | 285/901 |
| 4,906,496 | 3/1990 | Hosono et al. | 138/113 |

*Primary Examiner*—William A. Cuchlinski, Jr.
*Assistant Examiner*—G. Bradley Bennet
*Attorney, Agent, or Firm*—Nixon & Vanderhye

[57] ABSTRACT

A collar for a drain pipe riser is provided for maintaining an annular space about the periphery of the riser during the pouring of a floor about the riser. The collar includes inner and outer sleeves separated by a plurality of knock-out webs. The inner sleeve is adapted to fit over the riser while the outer sleeve insures an annular space will be maintained about the riser during pouring of the floor. The webs can then be knocked out, and the inner sleeve and webs removed.

16 Claims, 1 Drawing Sheet

DRAIN COLLAR

BACKGROUND OF THE INVENTION

This invention relates to apparatus for use with an upstanding sewer pipe riser or drain to facilitate the attachment of a toilet bowl outlet and associated sealing gasket. Specifically, the invention relates to a collar which maintains an annular space about the riser or drain during pouring of a concrete floor.

During the construction of buildings, plumbing pipes are normally partially installed, i.e., roughed in, prior to the completion of the floors and walls of the building. Thereafter, concrete floors are poured about the roughed in pipes, including upright risers designed to sealingly engage, for example, a toilet bowl outlet and associated sealing gasket. Unless an annular space is provided about the riser, connection of the riser to an appliance such as a toilet bowl is extremely difficult and, as a result, the concrete immediately surrounding the riser must be broken away.

Attempts have been made in the past to solve this problem by providing devices designed to maintain an annular space about the riser during the pouring of a concrete floor. For example, see U.S. Pat. No. 3,421,551 issued Jan. 14, 1969. This patent describes the use of a destructable foam plastic sleeve fitted about a riser. After pouring the floor, the sleeve is compressed and broken away with a tool such as a screwdriver to establish an annular cavity about the upper end of the riser.

The present invention relates to an improved device for maintaining an annular space about a drain pipe riser during the pouring of the concrete (or other) material floor. Specifically, the present invention in one exemplary embodiment includes a collar having an outer substantially cylindrical sleeve and an inner substantially cylindrical sleeve, the two sleeves being concentrically arranged and radially spaced from each other. The sleeves are temporarily held together by a plurality of "knock-out" fingers or webs which are secured between the inner and outer sleeves at both the upper and the lower ends of the sleeves. In the exemplary embodiment, the webs are arranged in a multiplicity of V-shaped configurations where adjacent webs are joined together on the interior surface of the outer sleeve, and are secured at circumferentially spaced locations on the exterior surface of the inner sleeve.

A knock-out cap or plate is provided at the upper end of the collar, covering the entire opening defined by the outer sleeve. The joints between the webs and sleeves are relatively weak, permitting the webs to be knocked-out to thereby enable separation of the inner and outer sleeves after the floor has been poured. The cap or plate is removable in a similar manner, and is utilized principally to prevent the inadvertent admission of wet concrete into the riser.

It will be appreciated by those of ordinary skill in the art that the drain collar disclosed herein can be produced in many different sizes for use with virtually any diameter riser. In a preferred arrangement, the entire collar including the inner and outer sleeves as well as the webs extending therebetween are constructed as a one-piece plastic collar.

It will be further appreciated by those of ordinary skill in the art that after the installation of the collar over the upright riser, a concrete floor may be poured, an annular space being reserved between the concrete and the riser, corresponding to the radial space between the inner and outer sleeves. Once the concrete has set, the knock-out webs and cap or plate may be broken away from the outer sleeve so that the inner sleeve and webs may be removed, leaving the outer sleeve adhered to the set concrete, and a well defined annular space surrounding the riser.

In accordance with one exemplary embodiment of the invention, therefore, the drain collar of this invention comprises an inner, substantially cylindrical sleeve adapted to fit over an upper open end portion of a drain riser; an outer, substantially cylindrical sleeve radially outwardly spaced from the inner sleeve; and a plurality of webs extending between the inner and outer sleeves to maintain a peripheral space of predetermined width therebetween.

Additional objects and advantages of the invention will become apparent upon consideration of the detailed discussion of the invention which follows.

DETAILED DESCRIPTION OF THE DRAWINGS

Figure 1:
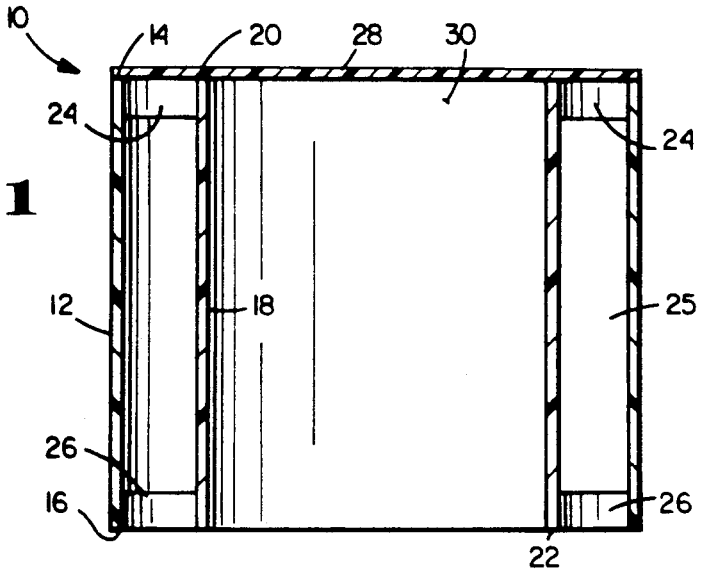
FIG. 1 is a cross section of a drain collar in accordance with this invention.
Figure 2:
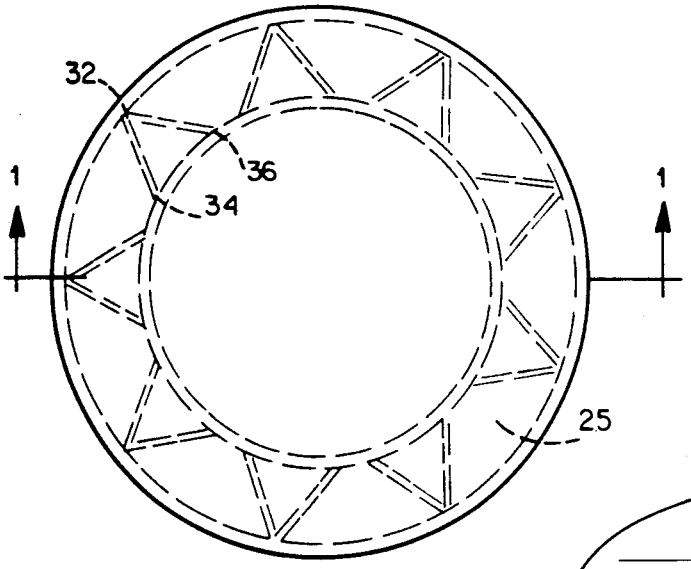
FIG. 2 is a plan view of a drain collar in accordance with this invention.
Figure 3:
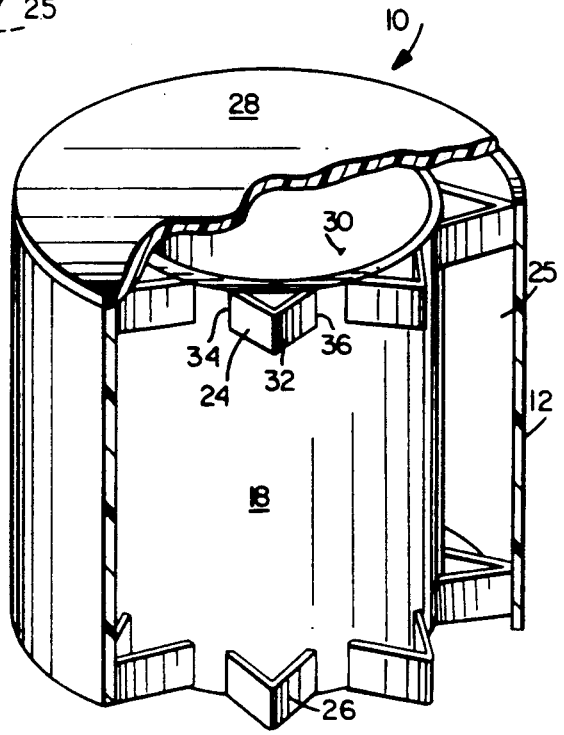
FIG. 3 is a perspective view of the drain collar illustrated in FIGS. 1 and 2.

With reference now to FIGS. 1-3, the drain collar 10 includes an outer, substantially cylindrical sleeve 12 having an upper peripheral or annular edge 14, and a lower peripheral or annular edge 16.

The collar also includes an inner, substantially cylindrical sleeve 18 having an upper peripheral edge 20 and a lower peripheral edge 22.

The sleeves 12 and 18 are temporarily held together by a plurality of "knock-out" fingers or webs 24 secured between the sleeves 12 and 18 at the upper end of the collar, so that the upper edges of the webs are flush with annular edges 14 and 20.

Similarly, a plurality of "knock-out" fingers or webs 26 are secured between the sleeves 12 and 18 at the lower end of the collar, so that the lower edges of the webs are flush with annular edges 16 and 22.

With reference to FIGS. 2 and 3, the rectangular fingers or webs 24 are arranged as a plurality of V-shaped configurations, where two adjacent webs 24 intersect as at 32 on the interior surface of the outer sleeve 12, and are secured at circumferentially spaced locations 34, 36 on the exterior surface of the inner sleeve 18. This arrangement is carried out about the entire circumferential space between the outer sleeve 12 and inner sleeve 18 at both the upper and lower ends of the collar. The invention is not intended to be limited to this arrangement, however, as any number of "knock-out" web configurations may be employed.

A "knock-out" cap or plate 28 is provided at the upper end of the collar, covering the entire opening defined by the outer sleeve 12.

In a preferred embodiment of the invention, the entire collar is constructed as a one-piece plastic device, although a light weight metal such as tin or aluminum could also be used.

In addition, the joints between the webs 24, 26 and sleeves 12, 18 are relatively weak, permitting the webs to be "knocked out" to thereby separate the inner and outer sleeves in a manner described in greater detail below. This can be accomplished by thinning the plastic material at the joints, or by applying light adhesive at the joints (if the collar is of multi-piece construction), etc. Similarly, the cap or plate 28 may be lightly adhered to one or the other or both peripheral edges 14, 20 to facilitate easy removal.

In one exemplary embodiment of the invention, the inner and outer sleeves are each 6 inches in height, and the inner sleeve has a peripheral wall thickness of 1/16 inch and the outer sleeve a thickness of ⅛ inch. The inner diameter of the inner sleeve 18 is 4 9/16 inches, while the outer diameter of the outer sleeve is 7 1/16 inches, thereby leaving an approximate 1 inch wide annular space 25 between the sleeves. Webs 24, 26 each have approximately a 1 inch length (spanning the width of the annular space), a ½ inch height and a thickness of 1/16 inch. The collar as described here is designed to fit a standard 4½ inch diameter drain pipe.

For other standard pipe diameters, (e.g., 2 ½, 3 ½, etc.) the inner and outer sleeve diameters will vary accordingly, but all other dimensions can remain the same. The height of the collar can also vary, depending on the construction plan, and the heights of 6 and 12 inches disclosed herein are merely exemplary.

In use, with a 4½ inch diameter drain riser, the above described sleeve, with an inner sleeve diameter of 4 9/16 inches, is placed over the exposed portion of the riser with the inner sleeve 18 snugly engaging the exterior surface of the riser, and the cap or plate 28 covering the open end of the riser. Concrete flooring may then be poured, with the collar preventing concrete from settling about the riser, and from inadvertently entering the interior of the riser.

After the concrete has cured, the webs 24, 26 may be knocked out, i.e., separated from the outer sleeve 12. At the same time, cap or plate 28 is also separated from the outer sleeve so that the inner sleeve, webs and cap may be discarded. This leaves the outer sleeve 12 adhered to the concrete (it may be broken away if desired), and an approximate one-inch wide space surrounding the riser, thereby facilitating the subsequent attachment of a toilet flange and associated sealing gasket.

It will be appreciated that although the collar has been described above with respect to the pouring of a concrete floor, the collar is usable in any environment where it is desired to maintain a clear space between a riser and surrounding flooring (or other) material.

In addition, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A drain collar adapted to be mounted on an end of a drain riser for maintaining an annular space about the end of the drain riser during the laying of a surrounding floor, the collar comprising:

an inner, substantially cylindrical sleeve adapted to fit over the upper open end portion of the drain riser;

an outer, substantially cylindrical sleeve radially outwardly spaced from said inner sleeve; and at least one plurality of knock-out webs extending axially and radially between, and fixedly secured to, said inner and outer sleeves to maintain a peripheral space of predetermined width therebetween, and further including means for enabling said plurality of knock-out webs and said inner sleeve to be separated from said outer sleeve and removed from the drain riser.

2. A drain collar according to claim 1 and further including a cap having a diameter substantially equal to a diameter of said outer sleeve.

3. A drain collar according to claim 1 wherein said at least one plurality of webs are provided at an upper end portion of said inner and outer sleeves, and a second plurality of webs are provided at a lower end portion of said inner and outer sleeves.

4. A drain collar according to claim 3 wherein said webs are arranged in an array about substantially the circumferential entirety of said peripheral space.

5. A drain collar according to claim 4 wherein each said web is in the form of substantially rectangular finger.

6. A drain collar according to claim 5 wherein said array comprises a plurality of adjacent V-shaped configurations each consisting of a pair of said fingers.

7. A drain collar adapted to be mounted on an upper end of a drain riser for maintaining an annular space about the upper end of the drain riser during the laying of a surrounding floor, the collar comprising:

an inner hollow cylindrical member having an open lower end;

an outer hollow cylindrical member having an open lower end;

a first plurality of separable knock-out webs fixedly secured between said inner and outer members adjacent upper ends thereof; and a second plurality of separable knock-out webs fixedly secured between said inner and outer members adjacent lower ends thereof, said first and second plurality of knock-out webs thereby enabling said inner sleeve and said first and second pluralities of knock-out webs to be separated from said outer sleeve and removed from the drain riser; and wherein a removable cap is separably attached to said outer sleeve and temporarily covers said upper ends of said inner and outer members and said upper ends of said riser.

8. A drain collar according to claim 7 wherein said webs are arranged in an array about substantially the circumferential entirety of said peripheral space.

9. A drain collar according to claim 8 wherein each said web is in the form of substantially rectangular finger.

10. A drain collar according to claim 9 wherein said array comprises a plurality of adjacent V-shaped configurations each consisting of a pair of said fingers.

11. A drain collar according to claim 7 wherein said collar is constructed of plastic.

12. A drain collar according to claim 7 wherein said inner cylindrical member has a diameter adapted to fit over a standard size drain pipe.

13. A drain collar for maintaining an annular space about the periphery of a riser during pouring of a floor, comprising:

first inner means for telescopically engaging an upper end portion of the riser;

second outer means radially outwardly spaced from said first means;

and axially and radially extending means fixedly secured between upper and lower ends of said first and second means, respectively, for enabling separation of said inner means and said axially and radially extending means from said outer means after pouring the floor.

14. A drain collar according to claim 13 wherein a breakable cover plate is mounted to said collar at upper ends of said first and second means.

15. A drain collar according to claim 13 wherein said breakable means comprises a plurality of fingers arranged in an array about lower ends of said inner and outer means.

16. A drain collar according to claim 13 wherein said first and second means are substantially coextensive and concentric with respect to each other.

* * * * *